US006131931A

United States Patent [19]

Globerson et al.

[11] Patent Number: 6,131,931

[45] Date of Patent: Oct. 17, 2000

[54] FOLDING SKATEBOARD

[76] Inventors: Justin David Globerson; Marlan Beth Globerson; Terry Lee Globerson, all of 2 Cintilar, Irvine, Calif. 92620

[21] Appl. No.: 08/829,956

[22] Filed: Apr. 1, 1997

[51] Int. Cl.[7] ..... A63C 17/01

[52] U.S. Cl. ..... 280/87.042; 280/20; 280/87.05; 403/102

[58] Field of Search ..... 108/83, 89, 167, 108/168; 280/20, 603, 32.6, 35, 641, 656, 87.041, 87.042, 87.05, 79.11; 403/83, 84, 102

[56] References Cited

U.S. PATENT DOCUMENTS

| | | | |
|---|---|---|---|
| 781,243 | 1/1905 | Thompson | 280/32.6 |
| 1,302,301 | 4/1919 | Broome | 280/32.6 |
| 1,851,600 | 3/1932 | Stanley | 403/167 |
| 1,997,239 | 4/1935 | Shea | 108/89 |
| 2,692,636 | 10/1954 | Morrison | 280/32.6 |
| 3,583,722 | 6/1971 | Jacobson | 280/20 X |
| 3,984,116 | 10/1976 | Bowers | 280/32.6 |
| 4,076,267 | 2/1978 | Lipscomb | 280/87.042 |
| 4,161,326 | 7/1979 | Gaber | 280/87.042 |
| 4,168,076 | 9/1979 | Johnson | 280/87.042 X |
| 4,458,907 | 7/1984 | Meredith | 280/87.05 X |
| 4,580,799 | 4/1986 | Quinonez | 280/32.6 |
| 5,417,444 | 5/1995 | Chen | 280/87.042 |
| 5,505,474 | 4/1996 | Yeh | 280/87.042 |
| 5,611,552 | 3/1997 | Miles et al. | 280/32.6 |
| 5,730,449 | 3/1998 | Miles | 280/32.6 |
| 5,769,438 | 6/1998 | Svetlov | 280/87.041 |

OTHER PUBLICATIONS

"Fold–A–Bord", Grade School Contest Entry, Justin D. Globerson, Dec. 11, 1995.

*Primary Examiner*—Michael Mar
*Attorney, Agent, or Firm*—Lawrence R. Franklin

[57] ABSTRACT

A conventionally shaped skateboard is divided into three sections, one section measures at about half the length of the skateboard, a middle section measures at approximately the height of the truck and wheel assembly, and a third section constitutes the remaining length of the skateboard. The three sections are hinged together to form a folding skateboard such that when the skateboard is folded, the trucks and wheels of the skateboard are adjacent each other in the interior of the J-shaped configuration of the folded skateboard. The sections are locked in an extended, aligned orientation to form a usable skateboard in three embodiments by clips which fit onto the side edges of the skateboard deck and in a fourth embodiment by rods which fit into and slide within cylindrical grooves formed on the bottom of the skateboard deck. The clips and rods are of such a length that they are long enough to span the middle section and a sufficient portion of the two sections to lock the skateboard open but short enough to fit on the longest section without protruding beyond its extremeties, when the skateboard is folded.

18 Claims, 3 Drawing Sheets

FOLDING SKATEBOARD

BACKGROUND OF THE INVENTION

Field of the Invention

This invention relates to a skateboard of the type used by young athletes for transportation and sport. Each skateboard includes the usual deck and a pair of trucks with wheels mounted thereon at opposite ends of the deck.

A recurring problem for skateboarders is the storage of the skateboard when it is not in use. This is especially a problem for young skateboarders who use their skateboards to go to work, school, or to a shopping center. There is nowhere to safely store the skateboard without risk of it being stolen. Bicycle racks are inappropriate and most lockers, if even available, are too small to store a standard skateboard.

OBJECTS AND SUMMARY OF THE INVENTION

The present invention overcomes the difficulties described above by providing a skateboard which folds so that it is compact enough to fit into a conventional backpack or locker. When opened, i.e., unfolded or extended, a locking means prevents collapse of the skateboard by holding it in its extended position. A flexible strap, secured into a loop by means of VELCRO® fastening, acts as a carrying handle, shoulder strap, or back strap. A second Velcro-securable strap holds the skateboard in its contracted position.

It is an object of the invention to provide a skateboard which can be folded when not in use, so as to facilitate carrying or storing thereof.

It is a further object of the invention to provide locking means for locking the skateboard in its open, extended condition by simple, reliable means which do not detract from the use or appearance of the skateboard.

It is a further object of the invention to provide locking means which can be a part of the skateboard and which can be stored on the skateboard.

It is a further object of the invention to provide locking means which are unitary in structure and thereby economical to manufacture and yet sturdy and trouble-free in use.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
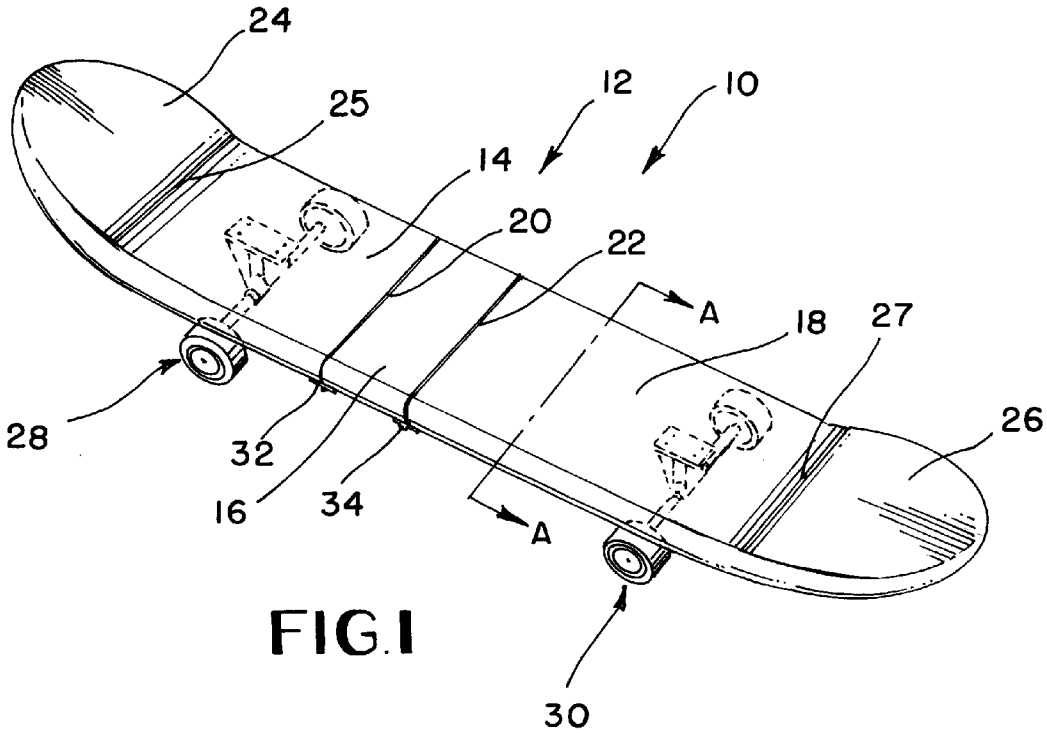
FIG. 1 is a perspective view which illustrates a preferred embodiment of the present invention in its open state without the locking means.
Figure 2:
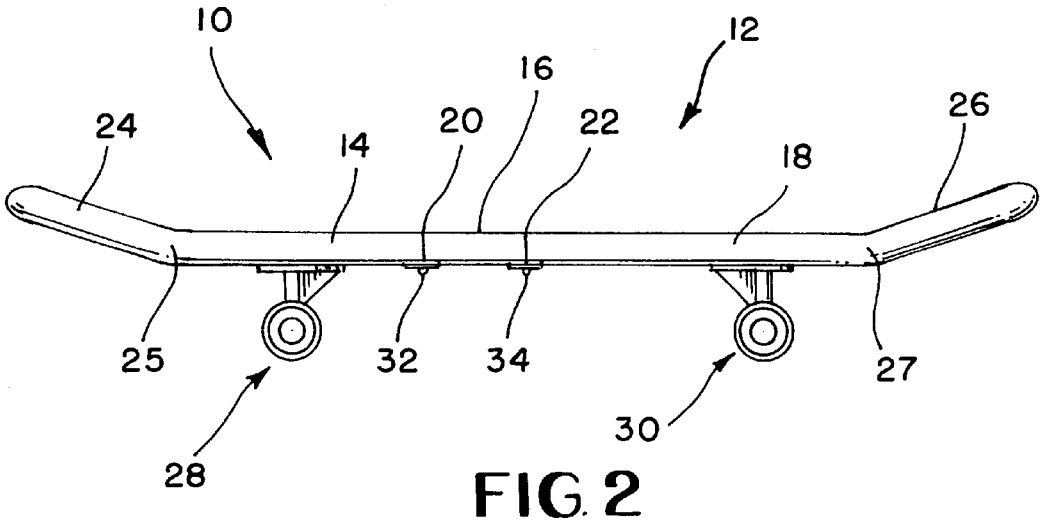
FIG. 2 is a side view of the invention of FIG. 1.
Figure 3:
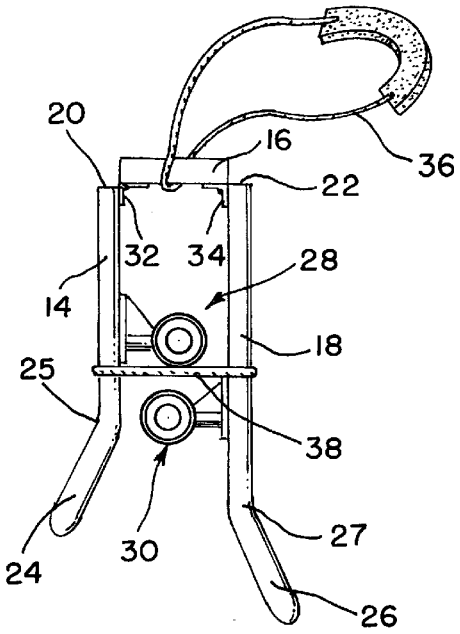
FIG. 3 is a side view of the invention in its folded state for carrying or for storage.

Referring to FIGS. 1–3 a skateboard 10 embodying the concepts of the invention is shown as having a deck 12 comprising three sections, a nose section 14, a middle section 16, and a tail section 18. The three sections are hinged at breaks 20 and 22. Break 22 is approximately at the middle of deck 12 with break 20 offset therefrom by about three to four inches, approximately the height of a truck-wheel assembly. Nose section 14 includes nose 24 which ascends from deck 12 at transverse bend 25 and tail section 18 includes tail 26 which ascends from deck 12 at transverse bend 27. Between bends 25 and 27, deck 12 is substantially flat. Some beginner boards are flat and do not have noses and tails which ascend; the concept of folding and locking them is also clearly within the scope of the claims. Truck-wheel assemblies 28 and 30 are attached in the usual way by bolts (not shown) through deck 12. Hinges 32 and 34 are mounted on the bottom of deck 12 adjacent breaks 20 and 22, respectively, so that when folded (FIG. 3), truck-wheel assemblies 28 and 30 are interior of the inverted J-shaped structure formed by sections 14–18. Hinges 32 and 34 are shown as piano hinges attached by means of screws or bolts (see FIG. 7), but they could, of course, be any convenient hinging means affixed to deck 12 in any suitable manner. As shown, nose section 14 is shorter than tail section 18, but it could as well be the other way around, i.e., nose section 14 could be longer than tail section 18; it is only important that one of these sections be longer than the other, for it enables truck-wheel assemblies 28 and 30 to be aligned adjacent each other in the orientation shown in FIG. 3, when skateboard 10 is folded, minimizing the folded length of the board. Optimally, the skateboard will be at its minimum folded length, if the length of the tail section is slightly longer than the sum of the length of the nose section plus the width of one of the truck-wheel assemblies. This allows the truck-wheel assemblies to just clear one another, forming a folded skateboard as compact as possible.

A shoulder strap 36 and a tie strap 38 are both made of Nylon webbing with VELCRO® fasteners included thereon to provide, respectively, a means for carrying skateboard 10, when folded, and for holding it securely in its folded state.

It can readily be seen in FIG. 2 that when a skater is atop skateboard 10 and his/her weight is centrally located on the top of deck 12, the weight will tend to press the confronting edges of breaks 20 and 22 together, since hinges 32 and 34 are affixed to the bottom of deck 12. This in itself would seem to assure a stable configuration of skateboard 10 when it is open and extended. However, a skater's weight is not always bearing centrally on the top surface of deck 12, especially during airborne stunts and when pressing on nose 24 and/or tail 26. A means for locking sections 14–18 in their open, aligned, extended orientation is necessary, therefore, to provide stability to skateboard 10 when in use.

Broadly speaking, the preferred locking means contemplated by the invention comprises a unitary structure with no moving parts made of a substantially rigid material resistant to bending. The locking means coacts directly with the deck without the use of intermediate structures. Such a locking means is simple in structure, which enhances its economy of manufacture as well as its durability in use. No locking means is shown in FIGS. 1–3, but the manner of use thereof will be apparent from FIGS. 4–9, where four preferred embodiments of locking means which meet the aforegiven criteria are disclosed.

Figure 4:
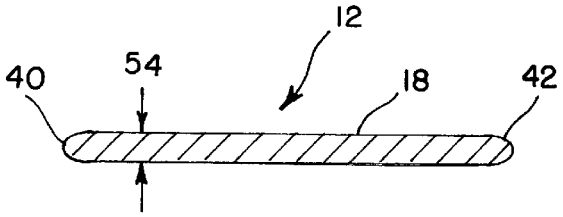
FIG. 4 is a cross-sectional view of the deck of a first embodiment of the invention as taken along lines A—A of FIG. 1.
Figure 4A:
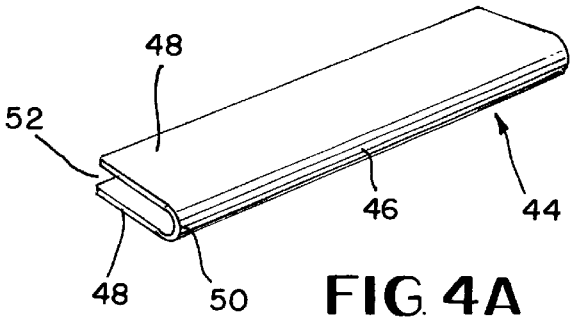
FIG. 4A is a perspective view of a locking means for the first embodiment of the invention.

FIGS. 4 and 4A show a first embodiment for locking the skateboard sections together. A transverse cross-section of skateboard 10 taken along lines A—A of FIG. 1 shows the usual skateboard deck shape (most decks are slightly concave in cross-section, but that feature is unimportant to the invention and has not been explicitly shown). Note that the side edges 40 and 42 which run along the entire length of the flat portion of deck 12, i.e., between bends 25 and 27, are simply rounded normally. For this embodiment, the usual prior art deck does not have to be modified at all in order to functionally coact with a locking means 44. Locking means 44 is a unitary clip 46 comprising a pair of flat surfaces 48 joined by an arcuate portion 50. Clip 46 is made from any suitable substantially rigid material, metal or plastic, e.g., stainless steel or polyethylene, which is resistant to bending. Clip 46 is U-shaped which partially encloses an interior space 52. It is within the purview of the invention for clip 46 to be slightly flexible to aid in snapping clip 46 onto side edges 40 and 42, although clip 46 can be slipped onto side edges 40 and 42 from their ends. When clip 46 is slightly flexible, the separation of surfaces 48 is slightly less than the top-to-bottom thickness 54 of deck 12, and the internal radius of curvature of arcuate portion 50 is commensurate with the radius of curvature of side edges 40 and 42. Clip 46 is long enough to span middle section 16 and a sufficient portion of nose section 14 and tail section 18 to lock skateboard 10 open. The precise length is not critical, so long as it coacts with side edges 40 and 42 to achieve its stated function. The length of clip 46 is limited by the necessity to store it, when skateboard 10 is folded, so it should not be so long that storage thereof becomes a problem. A preferred length is slightly less than the distance from break 22 to bend 27, for then clip 46 can be stored on the edge of the longest section of folded skateboard 10.

In use, skateboard 10 is opened and a pair of clips 46 are attached to side edges 40 and 42, taking care to span middle section 16 and a sufficient portion of nose section 14 and tail section 18, with the curved surfaces of side edges 40 and 42 snugly within interior spaces 52 in arcuate portions 50 of clips 46. The resiliency of clips 46, along with the frictional contact of the extended surface areas of flat surfaces 48 with deck 12, maintains clips 46 attached to deck 12 even under extreme usage of skateboard 10. When skateboard 10 is folded, clips 46 may be moved toward tail section 18, the longest section, until they are clear of hinge 34, so skateboard 10 can fold, but clips 46 will still remain on side edges 40 and 42 without having sharp end edges protruding therefrom.

Figure 5:
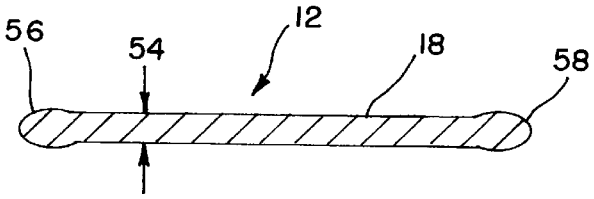
FIG. 5 is a cross-sectional view of the deck of a second embodiment of the invention as taken along lines A—A of FIG. 1.
Figure 5A:
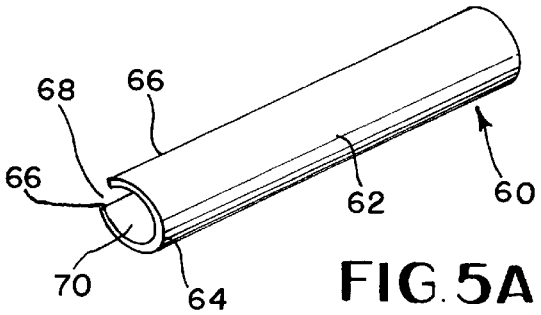
FIG. 5A is a perspective view of a locking means for the second embodiment of the invention.

In FIGS. 5 and 5A a second embodiment for locking the skateboard sections together is shown. Side edges 56 and 58 are enlarged relative to the thickness 54 of deck 12 to provide a Q-tip like look to the cross-section. Side edges 56 and 58 form a bulging lip running the length of the flat portion of deck 12. Locking means 60 is similar to clip 46 in that it is a unitary clip 62 made of a slightly flexible but substantially rigid material, and is of sufficient length to lock sections 14, 16, and 18 open and in alignment. Clip 62 has an arcuate C-shaped cross-section 64 whose edges 66 define a slot 68 and an interior space 70. The internal shape of interior space 70 is complementary to the arcuate shape of side edges 56 and 58, so that when clip 62 is placed thereon, it will snugly grip the bulging lip of side edges 56 and 58 sufficiently to resist accidental removal therefrom. As before, the length of clip 62 should be long enough to hold skateboard 10 open but short enough to be stored conveniently on the side edges of tail section 18. An alternative structure for clip 62 extends edges 66 to form flat surfaces (not shown) similar to flat surfaces 48 in the first embodiment to add more frictional contact with deck 12.

Figure 6:
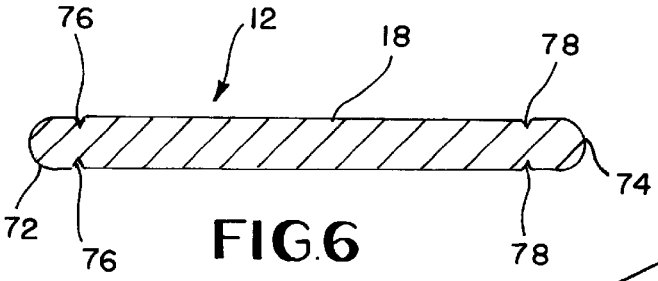
FIG. 6 is a cross-sectional view of the deck of a third embodiment of the invention as taken along lines A—A of FIG. 1.
Figure 6A:
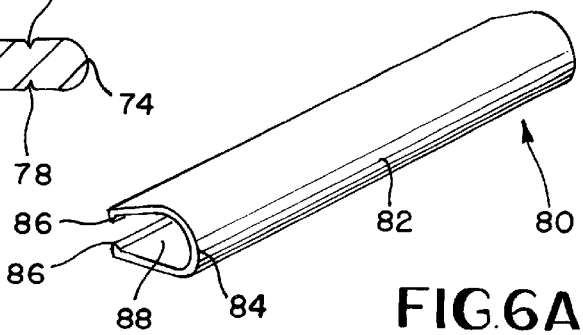
FIG. 6A is a perspective view of a locking means for the third embodiment of the invention.

In FIGS. 6 and 6A a third embodiment for locking the skateboard sections together is shown. Deck 12 has side edges 72 and 74 which again are rounded normally. Parallel to edges 72 and 74 and spaced slightly therefrom on the top and bottom surfaces of deck 12 are a pair of opposed grooves 76 and 78. Grooves 76 and 78 run the entire length of the flat portion of deck 12. Locking means 80 is similar to clips 46 and 62 in that it is a unitary clip 82 which meets the strength and length requirements discussed relative to clips 46 and 62. Clip 82 has a C-shaped cross-section 84 whose open edges comprise depending opposed flanges 86. When installed onto deck 12 flanges 86 reside in grooves 76 and 78 to forcibly retain clip 82 onto skateboard 10. As before, the arcuate interior 88 of clip 82 complements the outer arcuate surfaces of edges 72 and 74 to add frictional contact therebetween. This embodiment is especially suited for thicker boards where the presence of grooves 76 and 78 will not materially weaken deck 12

Figure 7:
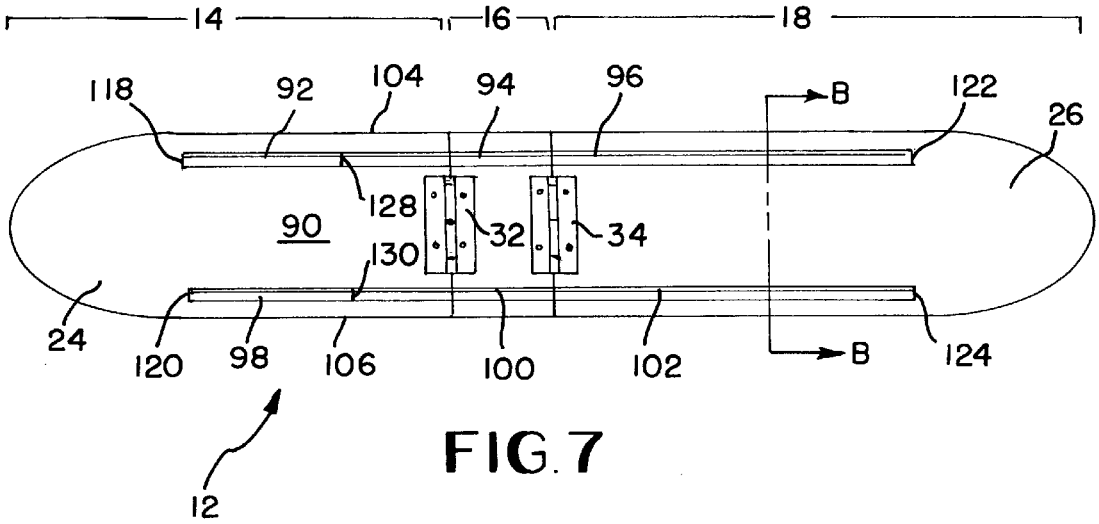
FIG. 7 is a bottom view of the deck showing a fourth embodiment of the invention.
Figure 8:
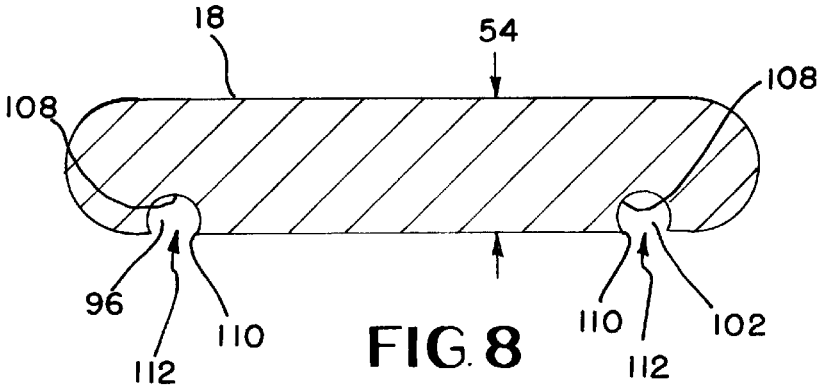
FIG. 8 is a cross-sectional view of the deck of the fourth embodiment of the invention as taken along lines B—B of FIG. 7.
Figure 9:
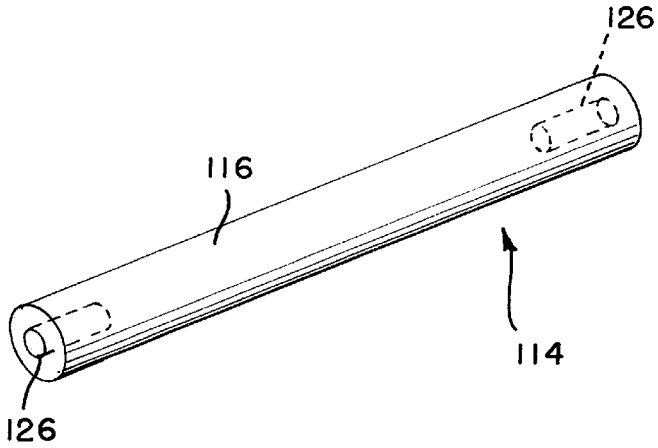
FIG. 9 is a perspective view of a locking means for the fourth embodiment of the invention.

Referring to FIGS. 7, 8, and 9, the underside 90 of deck 12 is shown in FIG. 7, where truck-wheel assemblies 28 and 30 have been removed to aid in the clarity of the drawings. As before, bottom 90 of deck 12 comprises nose section 14, middle section 16, and tail section 18 connected by hinges 32 and 34. Recessed into bottom 90 are two sets of cylindrical grooves 92–102. Grooves 92–96 are axially aligned, spaced from, and parallel to side edge 104 of deck 12; and grooves 98–102 are axially aligned, spaced from, and parallel to side edge 106 of deck 12. Grooves 92–102 have cylindrical internal walls 108 which extend less than 360° with confronting edges 10 bordering a slot 112, as shown in the cross-sectional view in FIG. 8. Locking means 114 comprises a cylindrical rod 116 having an external diameter corresponding to the internal diameter of grooves 92–102. Of course, rod 116 meets all the strength and length requirements of all of the previously disclosed locking means. In this embodiment, the thickness 54 of deck 12 is greater than the previous embodiments, so that deck 12 will have structural integrity despite the presence of grooves 92–102.

This embodiment allows for several alternatives.

In a first alternative, grooves 92 and 98 are open at ends 118 and 120 at bend 25 and/or grooves 96 and 102 are open at ends 122 and 124 at bend 27 where deck 12 bends to respectively form nose 24 and tail 26. In use, a pair of rods 116, one for each set of grooves, slide in grooves 92–96 and 98–102, respectively, to span a portion of nose section 14, all of middle section 16, and a portion of tail section 18 in order to rigidly lock skateboard 10 in its extended position.

A second alternative lends itself to a deck made of a synthetic material, such as a molded, foamed plastic. In this embodiment, ends 118–124 of grooves 92–102 are not open. Instead, they have solid end faces against which rods 116 abut when slid back and forth in grooves 92–102. Confronting edges 110 are resilient enough to flex and thereby allow passage of rods 116 laterally therethrough. Rods 116 are snapped into grooves 92–102 by applying pressure thereto. A suitable means for grasping rods 116 for sliding them into grooves 92–102 and for removing them therefrom is shown in FIG. 8A as a blind hole 126 bored axially into each end surface of rod 116. A hooked tool (not shown) similar to an Allen wrench is then inserted into hole 126 to grasp rod 116.

A third alternative comprises skateboard 10 being made of a material in which confronting edges 110 are rigid and do not flex, and, as in the second alternative, ends 118–124 of grooves 92–102 are not open. A rod 116 is entrapped in the each axially aligned set of grooves at manufacture and while they are capable of linearly sliding back and forth in the grooves, they are not intended to be removed from the grooves. In the second and third alternatives, grooves 92 and 98 can end in closed end faces 118 and 120, located such that, when rods 116 abut them, they are properly positioned for locking sections 14–18 extended and in alignment.

Hinges 32 and 34 can each be a pair of long, narrow hinges located parallel to the long sides of the skateboard, and, if desired, a third set of aligned grooves can be placed between the hinges midway of the two sets of grooves shown.

Rod 114 is also capable of variation. Instead of blind holes 126 in the ends of rods 116, blind holes in the cylindrical side surface of rods 116 (not shown) can be provided for insertion, movement, and removal of rods 116. A hollow rigid tube may be used instead of a solid rod. If a hollow tube is used as a locking means 116, radially located holes may be provided to aid in moving and/or removing them from grooves 92–102.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim:

1. A folding skateboard, comprising:

a deck, said deck having a first end section, a second end section, and a middle section therebetween with outer surfaces including top and bottom surfaces which are substantially longitudinally aligned when the skateboard is in an extended position;

first hinge means for connecting the first end section to said middle section for relative pivotal movement about a first axis extending transversely to a longitudinal axis of the skateboard;

second hinge means for connecting the second end section to said middle section for relative pivotal movement about a second axis extending transversely to the longitudinal axis of the skateboard;

first and second truck-wheel assemblies fixedly attached to the lower surface of said first and second end sections, respectively, each of said truck-wheel assemblies comprising a truck with wheels rotatably attached thereto, said first truck-wheel assembly being spaced a different distance along said longitudinal axis from said first hinge means than the spaced distance of said second truck-wheel assembly from said second hinge means, so that when said skateboard is folded, said first and second truck wheel assemblies are longitudinally spaced apart and remain out of contact with each other;

said middle section having a longitudinal length which is at least as long as the height of either of said first or second truck-wheel assemblies; and at least one locking means coacting directly with said deck for releasably constraining said first end section, said second end section, and said middle section in their extended position so as to form a usable skateboard, each said locking means comprising a single rigid, elongated, integrally formed locking member configured for maintaining simultaneous locking engagement with each of said first end section, said second end section, and said middle section when attached thereto.

2. The folding skateboard of claim 1 wherein each of said truck-wheel assemblies has a height and a width;

the length of said first end section is longer than the sum of the length of said second end section plus the width of one of said truck-wheel assemblies, and the length of said middle section is approximately the height of either one of said truck-wheel assemblies; and said hinge means is affixed to the bottom surface of said deck at junctures of said three sections.

3. The folding skateboard of claim 2 wherein said deck includes a nose and a tail, said first end section being integrally connected to one of said nose and said tail and said second end section being integrally connected to the other of said nose and said tail, and said longitudinally aligned outer surfaces comprises said first end section, said middle section, and said second end section each having a pair of substantially linear side edges which form a respective pair of aligned side edges when said skateboard is extended; and said at least one locking means comprises clip means for clipping onto at least one of said pair of aligned side edges to lock said three sections in an extended, aligned orientation.

4. The folding skateboard of claim 3 wherein said clip means comprises a pair of clips, each of which is of such a length as to be long enough to span said middle section and at least a part of said adjacent portions of said first and second end sections and short enough to fit on the side edges of only said first end section without the ends of said clips extending beyond said side edges of said first end section.

5. The folding skateboard of claim 4 wherein each said clip has a cross-sectional shape complementary to the cross-sectional shape of each of the side edges of said deck for gripping said side edges.

6. The folding skateboard of claim 5 wherein said each clip further includes a pair of opposing flat surfaces for gripping the top and bottom surfaces of said deck adjacent said side edges.

7. The folding skateboard of claim 5 wherein said side edges are arcuate and are enlarged along the length of said aligned side edges from the junctures of said nose and said tail with said first and second end sections, respectively.

8. The folding skateboard of claim 5 wherein said side edges include a pair of opposed grooves formed, respectively, in the top and bottom surfaces of said deck and parallel to said side edges and each said clip includes opposed, depending flanges which fit, respectively, within said grooves.

9. The folding skateboard of claim 2 wherein at least one set of cylindrical grooves is formed in axial alignment in the bottom surfaces of said three sections and the internal walls of said at least one set of cylindrical grooves extend less than 360° to form an open slot, said at least one locking means comprises at least one elongated cylindrical member which is resistant to bending and which fits within said cylindrical grooves to lock said three sections in an extended, aligned orientation.

10. The folding skateboard of claim 9 wherein a pair of said sets of cylindrical grooves are spaced from and substantially parallel to said side edges and a pair of said cylindrical members, one for each sets of grooves, fit therein to respectively lock said three sections in said extended, aligned orientation.

11. The folding skateboard of claim 10 wherein each of said cylindrical members is of such a length so as be long enough to span said middle section and an adjacent portion of said first and second end sections and short enough to fit in the groove of said first end section without the ends of each of said cylindrical members extending beyond said groove of said first end section.

12. The folding skateboard of claim 11 wherein each of said cylindrical members comprise a hollow tube.

13. The folding skateboard of claim 11 wherein said cylindrical grooves are open-ended such that said cylindrical members can be slid into said grooves from said open end.

14. The folding skateboard of claim 11 wherein each extreme end of said sets of cylindrical grooves are closed, and the confronting edges of said slots are flexible, whereby said cylindrical members may be snapped into and out of said grooves through said slots.

15. The folding skateboard of claim 14 wherein each of said cylindrical comprises a solid rod.

16. The folding skateboard of claim 15 wherein each of said rods includes an axially extending blind hole bored in at least one end face of said rod.

17. The folding skateboard of claim 11 wherein the confronting edges of said slot are rigid, and each end of said set of said cylindrical grooves are closed, whereby said cylindrical member is substantially limited to axially sliding movement in said grooves.

18. The folding skateboard of claim 17 wherein said cylindrical member comprises a hollow tube.

* * * * *